US007465063B2

(12) United States Patent
Stillman

(10) Patent No.: US 7,465,063 B2
(45) Date of Patent: Dec. 16, 2008

(54) ADJUSTABLE TRACK LIGHTING SYSTEM ADAPTED TO SUPPORT MULTIPLE TYPES OF LIGHT SOURCES

(76) Inventor: Allen M. Stillman, 80 N. Moore St. Apt. 19C, New York, NY (US) 10013

( * ) Notice: Subject to any disclaimer, the term of this patent is extended or adjusted under 35 U.S.C. 154(b) by 0 days.

(21) Appl. No.: 11/409,874

(22) Filed: Apr. 24, 2006

(65) Prior Publication Data

US 2006/0245186 A1 Nov. 2, 2006

Related U.S. Application Data

(60) Provisional application No. 60/675,232, filed on Apr. 27, 2005.

(51) Int. Cl.
*F21S 8/04* (2006.01)

(52) U.S. Cl. ..... 362/225; 362/219; 362/220; 362/238; 362/250; 362/648; 439/235

(58) Field of Classification Search ..... 362/219, 362/220, 225, 232, 238, 249, 250, 388, 648; 439/235; 248/68.1, 316.7
See application file for complete search history.

(56) References Cited

U.S. PATENT DOCUMENTS

| | | | | | |
|---|---|---|---|---|---|
| 4,803,606 | A | | 2/1989 | Rotter | 362/250 |
| 4,862,336 | A | | 8/1989 | Richardson | 362/285 |
| 4,881,156 | A | | 11/1989 | Chemnitz | 362/220 |
| 4,979,081 | A | * | 12/1990 | Leach et al. | 362/219 |
| 5,424,931 | A | * | 6/1995 | Wheeler | 362/418 |
| 5,702,177 | A | * | 12/1997 | Lin | 362/648 |
| 5,751,117 | A | * | 5/1998 | Abbott | 315/244 |
| 6,056,418 | A | * | 5/2000 | Hsu | 362/249 |
| 6,120,163 | A | | 9/2000 | Graber | 362/223 |
| 6,135,615 | A | * | 10/2000 | Lee | 362/648 |
| 6,523,975 | B1 | | 2/2003 | Plourde | 362/225 |
| 6,644,829 | B1 | | 11/2003 | Tracy | 362/220 |
| 6,802,626 | B2 | * | 10/2004 | Belfer et al. | 362/249 |
| 6,869,209 | B2 | * | 3/2005 | Layne et al. | 362/404 |
| 7,210,811 | B1 | * | 5/2007 | Swanson | 362/147 |
| 7,237,932 | B2 | * | 7/2007 | Ter-Hovhannissian | 362/485 |
| 7,246,935 | B2 | * | 7/2007 | Benghozi et al. | 362/648 |
| 2006/0012977 | A1 | * | 1/2006 | Joseph | 362/147 |

* cited by examiner

*Primary Examiner*—Jong-Suk (James) Lee
*Assistant Examiner*—Leah S Lovell
(74) *Attorney, Agent, or Firm*—Gordon D. Coplein

(57) ABSTRACT

A fixture for lamps used for portable and temporary applications has an elongated rail with a central channel, preferably with holes spaced along the channel bottom wall. Adapter bases are fit and fixed to the rail to support various types of light sources. In the case of a fluorescent lamp, each adapter base has one or more spring clamps into which a fluorescent lamp tube can be snapped and for other types of light sources the appropriate types of sockets and/or clamps, brackets or supports are provided. A wiring harness can be attached to the rail and secured by clips, clamps or holders attached to adapter bases along the rail. The rail with its attached light source or sources preferably has a flat back so that it can be mounted either permanently or temporarily to a flat surface by suitable fasteners or suspended from a ceiling or other elevated structure by a suitable tether.

13 Claims, 4 Drawing Sheets

ADJUSTABLE TRACK LIGHTING SYSTEM ADAPTED TO SUPPORT MULTIPLE TYPES OF LIGHT SOURCES

PRIORITY CLAIM

This application claims the benefit of priority under 35 U.S.C. §119(e) from U.S. Provisional application Ser. No. 60/675,232, filed Apr. 27, 2005 for "PORTABLE LIGHTING FIXTURE", the disclosure of which is incorporated by reference as if set forth fully herein.

FIELD OF THE INVENTION

The invention is in the field of fixtures for various types of light sources to be used in temporary and portable applications.

BACKGROUND OF THE INVENTION

A need exists to provide lighting in applications such as sessions where photographs are taken, such as, photographs for motion pictures, video and still photographs. Such sessions, sometimes called productions, often are held for only one or a few times and/or at locations where no permanent lighting equipment is provided that is adequate for the situation or where a primary lighting source or additional lighting is needed. In such cases, portable or temporary light sources are used. One such type of light source is provided by fluorescent lamps which are relatively inexpensive and provide a reasonable amount of light output in the visible spectrum range that is determined by the type of fluorescent lamp used. Such lamps can produce a cool and diffuse light. Other types of sessions require different types of lighting sources such as, for example, incandescent lights, LED cluster type lights, quartz-halogen, metal-halide, neon, cold-cathode, and so forth.

While fixtures are available that permit use of one or more fluorescent lamps or other types of lighting sources in such temporary situations, these are relatively cumbersome in appearance and to use. Accordingly, a need exists for a modular light fixture for fluorescent and other types of light sources that is better adapted for use in such portable and temporary applications.

BRIEF DESCRIPTION OF THE INVENTION

The present invention is directed to a fixture for one or more light sources that is more readily acceptable for portable use and in temporary applications. In accordance with the invention, a rail is used as a main support member for the fixture. The rail can be made of any suitable material, such as metal, plastic, fiberglass or carbon fiber. The rail is elongated and can be of rectangular or full or part circular shape. It also is of light weight and can be of any desired length. The rail material is selected to be able to withstand the heat produced by the light sources to be mounted to it.

The rail preferably is of the type that has an internal slot, track or channel along its length. Adapters, which serve as light source mounting supports or bases, are fit on the rail and held by a snap-fit arrangement or secured with a screw or by pressure or clamping. If the rail is of the type that has an internal slot, track or channel, the adapter can be slid along it to a desired position and held in place by a captive nut applied from the front of the rail.

In accordance with a preferred embodiment of the invention, the rail is of the channel type that preferably has a plurality of holes or elongated slots along its length. The adapter bases can be mounted to the rail by bolts passing through the holes or slots that are threaded into the adapter bases. Mounting devices that snap fit into the rail channel or over flanges of the rail also can be used to mount the adapter bases. This permits adjustable mounting of the light sources at different positions along the rail length and interchangeability of light sources mounted on adapter bases between different rails for different configurations and mixes of light sources. The holes or slots also allow a rigid or swivel mounting device mounted to be connected to the rail from the back of the rail. If no mounting device is used, then the back of the rail is flat and unobstructed and the rail can be attached to a flat wall, ceiling or other structural support by screws or other fasteners inserted from the front of the rail, or an adhesive, or VELCRO type fastener on the back of the rail. Wire or rope or other type of cord can be fastened in one or more of the holes or slots to suspend the rail and its attached light source or sources from a ceiling or other elevated support.

In a typical application where the fixture of the invention is to be used to support fluorescent lamps, a pair of adapter bases are mounted to the rail spaced apart by a desired distance. An adapter base can be at or near each end of the rail if the rail is of about the same length as the lamps or at any intermediate positions of the lamp length. The rail also can be longer or shorter than the length of the lamps. Each adapter base or support has one or more spring clips, each to engage and hold a fluorescent lamp tube. The lamp terminals at the end of each tube are accessible so that one or more sockets of an external ballast or ballasts can be connected to supply electrical power to the lamp or lamps. A variety of other shaped plug-in type fluorescent lamps, such as U-shaped, can also be held by the rail by using appropriately shaped adapters. There also can be linear incandescent lamps, which look much like fluorescent lamps, and which would be supported at the ends with or without additional adapter support plates in between.

The fixture also can be used to support one or more incandescent or other types of lamps such as high intensity discharge, metal-halide and the other types mentioned above. Here, the proper type sockets are mounted on the adapter supports or bases attached at suitable locations along the rail length. The lamp sockets can be of either of the screw base or bayonet type.

BRIEF DESCRIPTION OF THE DRAWINGS

Other objects and advantages of the present invention will become more apparent upon reference to the following specification and annexed drawings in which.

DETAILED DESCRIPTION OF THE INVENTION

Figure 1:
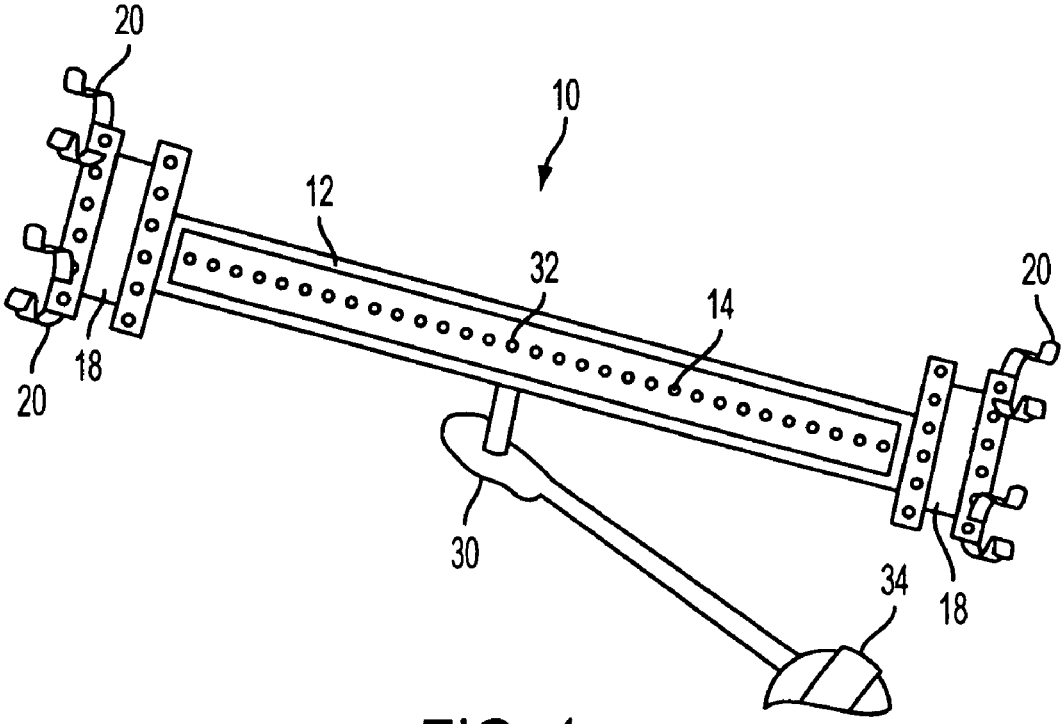
FIG. 1 is a longitudinal perspective view of the rail forming the fixture without lamps.
Figure 2:
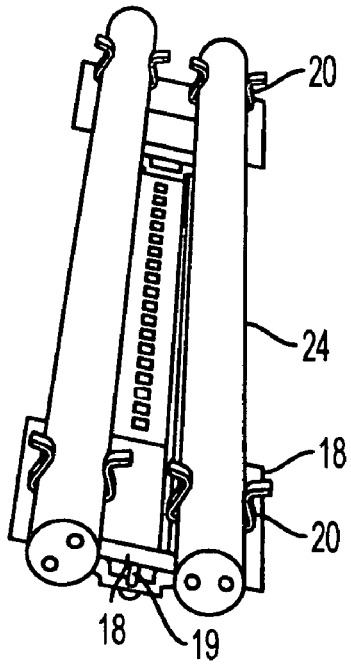
FIG. 2 is a side perspective view of the fixture with two fluorescent lamps mounted.
Figure 5A:
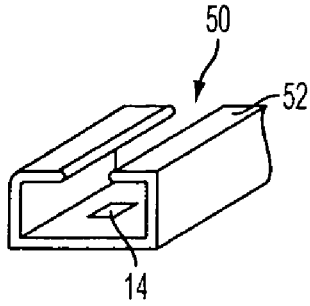
FIGS. 5A-5D show cross sections of different types of rails.
Figure 5B:
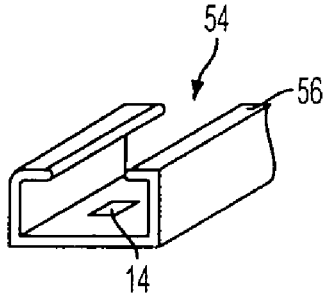

Referring to FIGS. 1 and 2, the fixture 10 has an elongated rail 12 which can be of metal, plastic or any other suitable material that is strong and rigid enough to support the devices to be mounted to it. The material of the rail also has the necessary heat resistant characteristics so that it will not be damaged by the heat produced by the one or more light sources to be mounted to it. The rail 12 has a channel type construction with either out or in turned edges, or flanges, as shown in FIGS. 5A-5B. The channel of rail 12 has a plurality of holes or elongated slots 14 along its length in the channel. Adapter bases can be mounted to the rail using bolts that pass through the holes or slots or by using other mounting devices as described below. While the rail is shown as being of generally rectangular shape, it can also be of any other shape such as square, semi-triangular, or fully or-part circular. The rail 12 is of any desired length.

Figure 3:
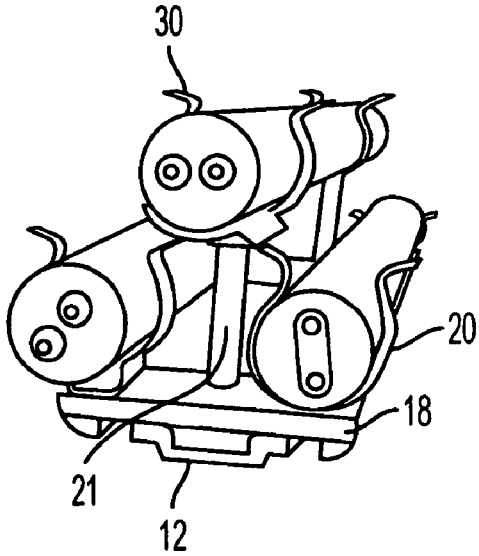
FIG. 3 is a perspective view showing a fixture with three fluorescent lamps mounted.

In preferred embodiments of the invention, as shown in FIGS. 1-3, the fixture 10 is to accommodate one or more fluorescent lamps. Therefore, rail 12 is at least long enough to accommodate conventional 2, 4, 6 or 8 foot long fluorescent lamp tubes. The rail can be shorter or longer than the length of the lamp tubes. Also, the rail can be long enough to support a plurality of lamp tubes of the same or different lengths that are mounted in a row along the rail.

Figure 6A:
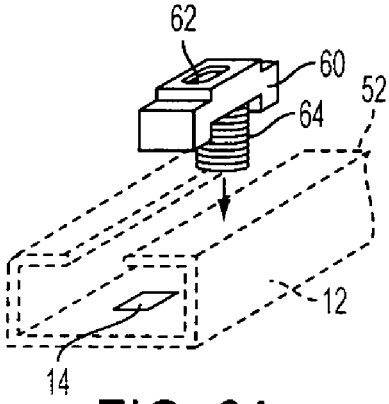
FIGS. 6A-6C show a spring loaded mount in a rail to which an adapter can be attached.
Figure 6B:
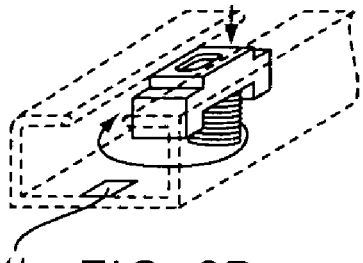
Figure 6C:
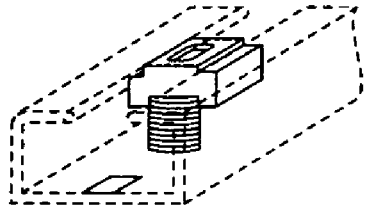

In the embodiment of FIGS. 1 and 2, a pair of adapter bases 18 are secured to the rail spaced apart by a distance generally corresponding to the length of the lamp tube and preferably at or near each end of a rail that is only somewhat longer than the lamp tube length. The adapter base 18 can be at intermediate points along the length of the lamp tube or tubes to be supported. Each adapter is fixed to the rail by one or more suitable fasteners. These can be one or more screws or bolts 19 as shown that pass through a hole or slot 14 to mate with the adapter 18 which can have a threaded section. Other suitable-mounting arrangements include a snap-fit of the adapter base to the rail edges or fingers that engage the internal side walls of the rail channel or other types of fastening devices such as shown in FIGS. 6A-6C. Another arrangement is securing the adapter base to a captive nut that slides in the rail channel. The latter devices are preferable to keep the back of the rail flat so that it can be secured to a flat surface such as a wall or ceiling. As shown, each adapter 18 is of generally rectangular shape, although it could be of another suitable shape. If the rail is circular, a flat adapter base is used that is attached to a collar that slides along the rail and is held in place with a lock-down screw or fastener.

A pair of spring clips 20 is mounted to each adapter 18 by any suitable fastener or by welding. Each spring clip 20 is of a shape, size and strength so that a fluorescent lamp tube 24 can be snapped in and securely held. As seen in FIG. 2, the lamp fixture 10 holds two fluorescent lamp tubes 24 of any desired length with one end of each lamp tube being snapped into and held in one of the clips 20 at the opposite ends of rail 12. The lamp terminals are exposed and readily accessible for sockets (not shown) from an external electrical ballast of suitable and conventional construction (also not shown) to be connected to supply electrical power to the lamps.

It is possible to mount an elongated light source such as a fluorescent tube to the rail using only one adapter base. Here, the clip would engage the tube near its center of weight. Such an arrangement can be used for tubes of short length and lighter weight but is not as secure as using at least two clamps.

If desired for additional support of the fluorescent lamp tubes 24, an adapter base 18 with spring clips 20 can be mounted at an intermediate point along the rail and lamp tube length. The fixture 10 of FIGS. 1 and 2 having the spring clips 20 also can be used to hold one or more linear type incandescent lamps.

If the configuration of light sources mounted to the rail is such that no elements of the adapter base mounting devices extend out of the back of the rail, then the back of the rail 12 is flat so that it can be mounted on a flat surface either permanently, such as by screws passed though the holes 14, or temporarily such as by an adhesive or VELCRO type fasteners. FIG. 1, shows another mounting arrangement for the rail in which a universal swivel type mount is provided for the fixture. Here the back of the rail does not have to be flat. The mount has a swivel joint 30 and the end 32 of a shaft extending from the swivel joint being in the rail channel fixed to one or more of the holes 14 in the rail 12 at any desired location along the rail length. A device 34 provided at the end the elongated rod extending from the swivel joint 30 can be fastened to any external object or support and the rail positioned by the swivel joint 30 so that light from the lamp tubes 24 can be directed to any location or spot. Other types of rail mounting arrangements can be used such as fastening one or more brackets to a wall or ceiling with the brackets having loops or hangers that engage and hold the rail. Still another arrangement is to provide a yoke or tether having an arm connected to each end of the rail and a central member to be mounted to a fixed point such as a ceiling or wall.

FIG. 3 shows another embodiment of the fixture in which the adapter base 18 has a vertical extension 21 that supports a third lamp bulb clip 29. Using this configuration, the fixture can support three lamp tubes 24. Here also, the swivel mount of FIG. 1 can be used. Other mounting configurations of fluorescent can be accomplished, such as three, four or more in a planar arrangement such as shown in FIGS. 1 and 2, two or more lamp tubes arranged vertically, and arrays of lamps on opposite sides of a double rail such as of the type shown in FIG. 5D.

FIG. 3 shows another embodiment of the fixture in which the adapter base 18 has a vertical extension 21 that supports a third lamp bulb clip 30. Using this configuration, the fixture can support three lamp tubes 24. Here also, the swivel mount 30 can be used. Other mounting configurations of fluorescent can be accomplished, such as three, four or more in a planar arrangement such as shown in FIGS. 1 and 2, two or more lamp tubes arranged vertically, and arrays of lamps on opposite sides of a double rail such as of the type shown in FIG. 5D.

Figure 4:
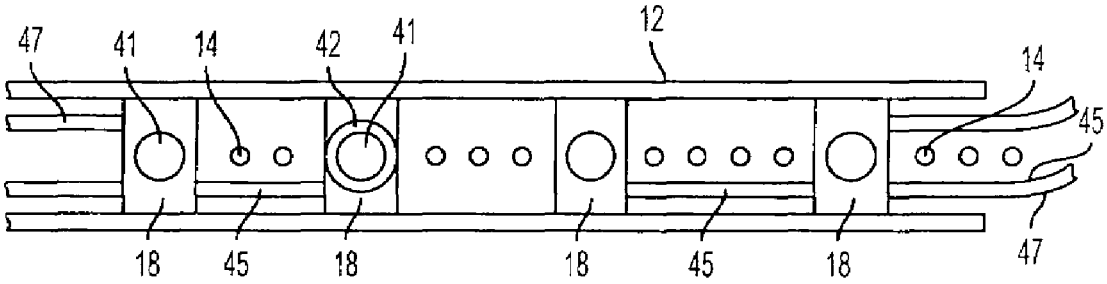
FIG. 4 is a longitudinal top view of the fixture using incandescent lamps in which a row of lamp sockets are mounted on the rail.

FIG. 4 shows a further embodiment of the invention for holding one or more light sources having bases such as of the incandescent lamp or other similar types. Here the rail 12 illustratively is of the channel type having inwardly turned edges, such as shown in FIGS. 5A-5B, and a plurality of adapter bases 18 are secured in the rail channel spaced apart as desired along the rail length. Each adapter base 18 carries a socket 41 that can hold an incandescent lamp 42 or other type of lamp. The terminals of the socket extend under the adapter base spaced from the bottom of the rail channel wall and are suitably electrically insulated. The wires 45 of each of the sockets 41 can be placed in the rail channel and the free ends 47 connected in any desired electrical configuration, such as serial or parallel. One or more adapter bases can be mounted along the length of the rail to support wire harnessing clips or holders.

Figure 5C:
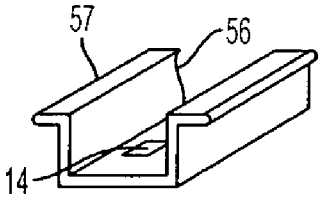
Figure 5D:
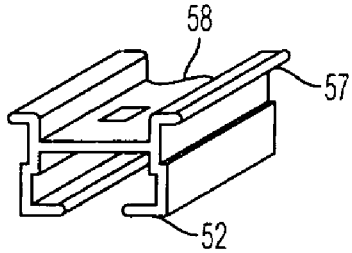

FIGS. 5A-5D show cross sections of different types of rails. In FIG. 5A the rail 50 has inwardly turned flanges 52 and in FIG. 5B the ends of the inwardly turned flanges 56 of the rail 54 are chamfered. In FIG. 5C the flanges 57 of the rail are turned outwardly. FIG. 5D shows a double rail 58 that is a combination having both inwardly turned flanges 52 on one side and outwardly turned flanges 57 on the other side although both sides of the rail could have the same types of flanges. Different types of adapter bases 18 are mounted to the flanges of these rails as appropriate.

FIGS. 6A-6C show a mounting arrangement that includes a fastener device 60 with a threaded hole 62 accessible from its top. The arrangement includes a coil spring 64 so that when the device 60 is slid in the channel of the rail 12 the spring pushes it against the in-turned flanges of the rail and secures it in the rail. An adapter 18 (not shown) is threaded into the screw hole 62.

Figure 7:
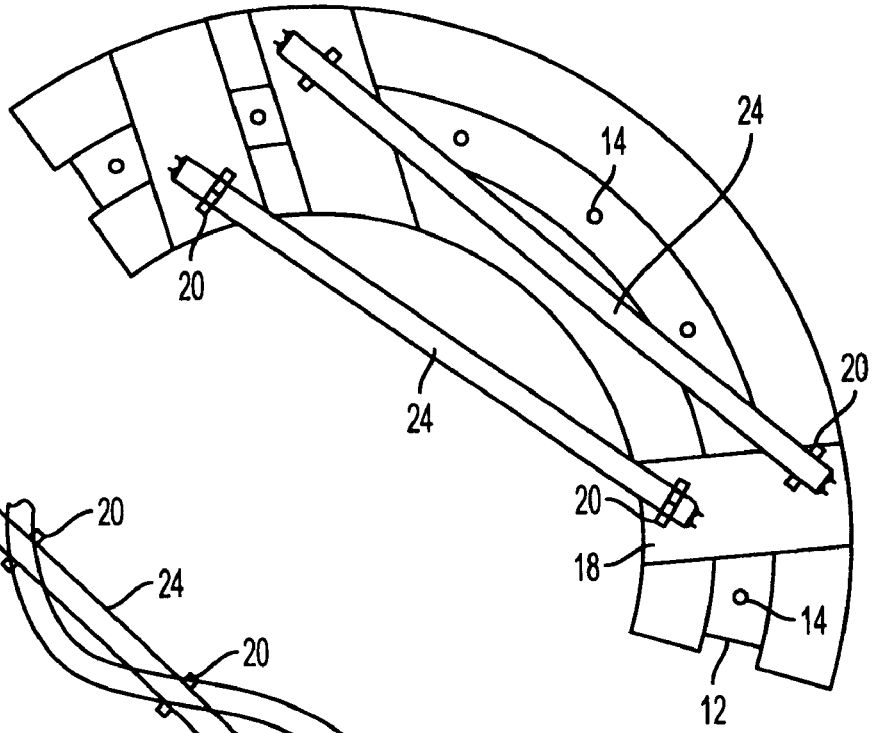
FIGS. 7 and 8 are pin views of fixtures with curved rails.
Figure 8:
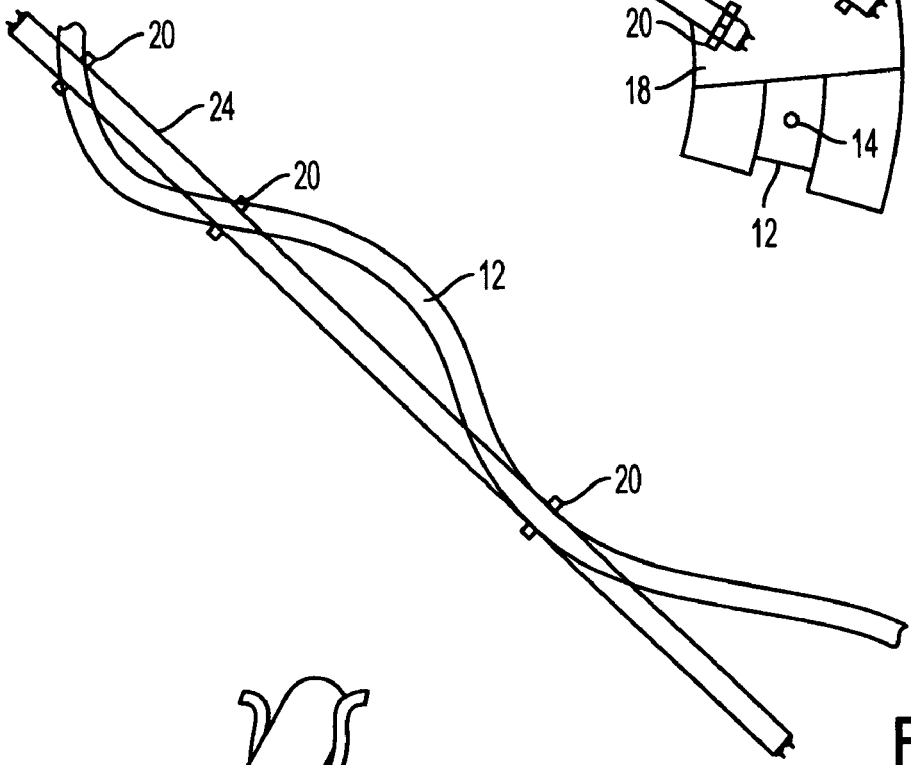
Figure 9:
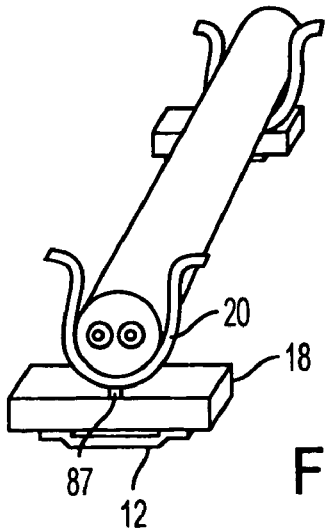
FIG. 9 is an end perspective view of a swivel mounting for and adapter base.

The elongated rails of the embodiments of FIGS. 1-4 are straight. It is also possible to have elongated rails that are curved and this is shown in FIGS. 7 and 8. In FIG. 7 the rail 12 is curved and in FIG. 8 it is of serpentine shape. In FIG. 8 the adapter base 18 is shown mounted on the outwardly turned lips of the rail 12. In each of these embodiments the clip 20 to hold the fluorescent lamp tube preferably is mounted on a swivel 87 as shown in FIG. 9. Fluorescent bulbs or long linear light sources can be mounted more easily if the clips 20 are turned to accommodate the radius or bend of the rail. In the fixtures of FIGS. 7-8 a portion of at least one of the lamp tubes is free and spaced away from the rail.

The rail can be rolled or formed into a curved or round shape to fit to a scenery wall, lighting or grid pipe or other scenic or display element. A curved cyclorama or backdrop can have a rail attached to the pipe or batten that it hangs from. The rail also could be bent, formed, shaped or cut to fit the dimensions of any scenery, display, exhibit or set element, curtains, backdrops, screens or signage. Adapter bases 18 for other than fluorescent lamps can be mounted along a curved rail such as shown in FIG. 4. The mounting integrity of the rail allowing for sockets or holders to be clipped onto or bolted to the rail remains if it is bent, shaped, or formed properly.

The rail fixture mounting system has heretofore been described independently of any reflector or reflector system. An advantage of using bare fluorescent lamps or other sources with a lightweight easily mounted rail as disclosed is that the ceiling, walls or surfaces of a set or a room becomes the reflector. Currently without the rail bare fluorescent bulbs are usually taped, cable-tied to mounts, glued or mounted with VELCRO individually to the surfaces and are hard to remove.

A complete fixture with a reflector can be assembled using the rail fixture of the invention. The rail can have a reflector or reflective material attached to it to create a more controllable and directional light source. The reflector can be fixed or detachable. The reflector can be formed, bent or shaped to collect the light from a linear source or individual bulbs to focus the light. The type of reflector surface can be selected to provide for different light output characteristics.

Detachable reflectors can be used to change the lighting characteristics of a single rail fixture. A modular light fixture can be developed from the basic rail fixture. The reflector and light control device adaptability can be expanded as far as money and time will allow . . . .

A diffuser or other light modifying accessory, like an "egg-crate" or hood or "snoot" can be attached in front of the rail to diffuse, modify, focus or control the direction and spread of light of the fixture. These accessories can be removably or permanently attached to the rail.

Readily available colored gel filters for photographic color correction, effects, light diffusion, reduction and control in sheets or rolls and can be clipped around and/or to the rail. All of the above can be used alone or in combination as appropriate.

"Spill" or extraneous light can be controlled, shaped or prevented with doors ("barn-doors") or other light shaping or control devices mounted to the rail.

The fixture of the invention is relatively simple, light in weight, and of inexpensive construction as compared to prior art fixtures for the same general purpose. It also provides the capability of being constructed and mounted in a variety of ways to satisfy different applications and is adaptable for use with various devices for modifying and controlling the overall light output.

Specific features of the invention are shown in one or more of the drawings for convenience only, as each feature may be combined with other features in accordance with the invention. Alternative embodiments will be recognized by those skilled in the art and are intended to be included within the scope of the claims. Accordingly, the above description should be construed as illustrating and not limiting the scope of the invention. All such obvious changes and modifications are within the patented scope of the appended claims.

I claim:

1. An adjustable track lighting system comprising:

an elongated rail;

an adapter base detachably mounted to said rail at a desired location along its length;

a fastener device for holding said adapter base to said rail;

a pair of spring clips mounted on said adapter base, each said spring clip of said pair of spring clips to engage and hold the envelope of a respective light source; and an extension piece mounted to each said adapter base; and a further spring clip mounted to said extension piece above the said pair of spring clips to engage and hold a further light source.

2. The adjustable track lighting system as claimed in claim 1 wherein:

said elongated rail has side walls that extend upwardly from a bottom wall to form a channel and having one or both of in-turned or out-turned flat flanges extending transversely from the upper ends of said side wall and that leave an access to said channel;

said adapter base has a lower surface with a flat portion; and said fastener device mounts said adapter base to said rail at a desired location along its length with said adapter base lower surface flat portion on top of and engaging against the upper surface of each of said rail flat flanges.

3. The system of claim 2 wherein said rail flanges are in-turned and said fastener device comprises a spring loaded member that engages the in-turned flanges.

4. The system of claim 2 further comprising:

a swivel base having the end of an arm mounted to said rail.

5. The system of claim 1 wherein each said light source and said further light source is a fluorescent lamp.

6. The system of claim 2 wherein said rail has a plurality of holes in its bottom wall along its length for mounting of said fastener device.

7. An adjustable track lighting system comprising:

an elongated rail;

a pair of adapter bases detachably mounted to said rail spaced apart at desired locations along a length of said rail;

a pair of spring clips mounted on each said adapter base, each said spring clip of said pair of spring clips to engage and hold the envelope of a respective light source;

an extension piece mounted to said adapter base; and a further spring clip mounted to said extension piece above the said pair of spring clips to engage and hold a further light source.

8. The system of claim 7 wherein each said light source and said further light source is a fluorescent lamp.

9. The system of claim 7 wherein said rail is curved.

10. The adjustable track lighting system as claimed in claim 7 wherein:

said elongated rail has side walls that extend upwardly from a bottom wall to form a channel and having one or both of in-turned or out-turned flat flanges extending transversely from the upper ends of said side wall and that leave an access to said channel;

said adapter base has a lower surface with a flat portion; and said fastener device mounts said adapter base to said rail at a desired location along its length with said adapter base lower surface flat portion on top of and engaging against the upper surface of each of said rail flat flanges.

11. The system of claim 7 wherein said rail has a plurality of holes in its bottom wall along its length for mounting of said fastener device.

12. The system of claim 7 wherein said rail flanges are in-turned and said fastener device comprises a spring loaded member that engages the in-turned flanges.

13. The system of claim 7 further comprising:

a swivel base having the end of an arm mounted to said rail.

* * * * *